US009763482B2

(12) United States Patent
Carcich et al.

(10) Patent No.: US 9,763,482 B2
(45) Date of Patent: Sep. 19, 2017

(54) NECK GAITER

(75) Inventors: Jennifer Carcich, Washington, DC (US); Shannon Burch, Lutherville, MD (US); Larissa Grashian, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 1023 days.

(21) Appl. No.: 13/332,981

(22) Filed: Dec. 21, 2011

(65) Prior Publication Data

US 2013/0160180 A1 Jun. 27, 2013

(51) Int. Cl.

*A41D 27/28* (2006.01)
*A41D 31/00* (2006.01)
*A41D 3/00* (2006.01)

(52) U.S. Cl.

CPC ..... *A41D 3/005* (2013.01); *A41D 31/0005* (2013.01)

(58) Field of Classification Search

CPC ..... A41D 1/04; A41D 13/002; A41D 1/08; A41D 27/28; A41D 31/0005; A41D 3/005; A41D 13/0015; A41D 13/11; A41D 15/00; A41D 15/04; A41D 20/005; A41D 23/00; A41D 2400/10; A41D 2400/14; A41D 2400/22; A41D 31/0033; A41D 31/0038

USPC ... 2/69, 77, 84, 91, 116, 127, 129, 139, 173, 2/202–208

See application file for complete search history.

(56) References Cited

U.S. PATENT DOCUMENTS

| | | | | | |
|---|---|---|---|---|---|
| 774,703 | A | * | 11/1904 | Scott | 2/206 |
| 808,543 | A | | 12/1905 | Horak | |
| 837,143 | A | * | 11/1906 | Starr | 66/171 |
| 958,977 | A | | 5/1910 | Shotland | |
| 2,269,491 | A | * | 1/1942 | Snyder | 2/90 |
| 3,607,593 | A | * | 9/1971 | Semenzato | 442/223 |
| 3,832,737 | A | * | 9/1974 | Podolsky | 2/132 |
| 4,475,673 | A | * | 10/1984 | Ochiai | 223/70 |
| 4,495,660 | A | * | 1/1985 | Hayden | 2/91 |
| 4,843,647 | A | * | 7/1989 | Phillips et al. | 2/69 |
| 4,944,041 | A | | 7/1990 | Buenos et al. | |
| 5,007,112 | A | * | 4/1991 | Lewis et al. | 2/457 |
| 5,088,115 | A | * | 2/1992 | Napolitano | 2/69 |
| 5,206,957 | A | * | 5/1993 | Gulick | 2/84 |
| 5,484,448 | A | * | 1/1996 | Steele et al. | 607/108 |
| 5,526,532 | A | * | 6/1996 | Willard | 2/69 |
| 5,651,140 | A | * | 7/1997 | Gibson | 2/46 |
| 5,664,259 | A | | 9/1997 | Budd | |
| 5,724,836 | A | * | 3/1998 | Green | 66/185 |
| 5,733,626 | A | * | 3/1998 | Middleton | 428/131 |
| 5,822,794 | A | * | 10/1998 | Allred | 2/115 |
| 5,881,405 | A | * | 3/1999 | Garrigues | 5/413 R |
| 6,018,819 | A | * | 2/2000 | King et al. | 2/69 |
| 6,028,017 | A | * | 2/2000 | Curtin et al. | 442/370 |

(Continued)

OTHER PUBLICATIONS

"Turtleneck." Merriam-Webster.com. Merriam-Webster, n.d. Web. Jan. 8, 2015. <http://www.merriam-webster.com/dictionary/turtleneck>.*

*Primary Examiner* — Bobby Muromoto, Jr.
(74) *Attorney, Agent, or Firm* — Maginot, Moore & Beck LLP

(57) ABSTRACT

A garment includes a torso portion and a turtleneck portion. The turtleneck portion extends from the torso portion. The turtleneck portion includes a first panel made of a first material and a second panel made of a second material. The second material is more permeable than the first material.

20 Claims, 6 Drawing Sheets

(56) References Cited

U.S. PATENT DOCUMENTS

| | | | | |
|---|---|---|---|---|
| 6,049,908 | A * | 4/2000 | Bullock et al. | 2/69 |
| 6,263,511 | B1 * | 7/2001 | Moretti | 2/97 |
| 6,277,479 | B1 * | 8/2001 | Campbell et al. | 428/213 |
| 6,308,344 | B1 * | 10/2001 | Spink | 2/458 |
| 6,332,221 | B1 * | 12/2001 | Gracey | 2/69 |
| 6,418,559 | B1 * | 7/2002 | Wrecsics et al. | 2/127 |
| 6,427,242 | B1 * | 8/2002 | Bush et al. | 2/69 |
| D474,875 | S | 5/2003 | Lee | |
| 6,596,019 | B2 * | 7/2003 | Turner et al. | 607/108 |
| 6,663,611 | B2 * | 12/2003 | Blaney et al. | 604/385.01 |
| 6,668,386 | B2 | 12/2003 | Vidal | |
| 6,909,028 | B1 * | 6/2005 | Shawver et al. | 604/370 |
| 7,043,765 | B1 * | 5/2006 | Otsubo | 2/69 |
| 7,043,767 | B2 * | 5/2006 | Jaeger | 2/87 |
| 7,108,900 | B1 * | 9/2006 | Manning Porter | 428/35.7 |
| 7,111,328 | B2 * | 9/2006 | Bay | 2/86 |
| 7,137,150 | B2 * | 11/2006 | Larson | 2/202 |
| 7,228,858 | B2 | 6/2007 | Baker | |
| 7,260,853 | B2 * | 8/2007 | Newman | 2/115 |
| 7,272,946 | B2 * | 9/2007 | Ichigaya | 62/259.3 |
| 7,296,328 | B1 * | 11/2007 | Petri et al. | 26/27 |
| 7,302,710 | B2 * | 12/2007 | Thomas et al. | 2/84 |
| 7,318,239 | B2 * | 1/2008 | Wood et al. | 2/69 |
| 7,429,206 | B2 * | 9/2008 | Perry | 450/86 |
| 7,514,380 | B2 * | 4/2009 | Chen et al. | 442/394 |
| 7,540,039 | B2 * | 6/2009 | Reaux | 2/424 |
| 7,560,399 | B2 * | 7/2009 | Rock et al. | 442/76 |
| 7,682,994 | B2 * | 3/2010 | Van Emden et al. | 442/181 |
| 7,743,476 | B2 * | 6/2010 | Rock et al. | 28/160 |
| 7,820,571 | B2 * | 10/2010 | Kuroda et al. | 442/301 |
| 7,842,628 | B2 * | 11/2010 | Yasui et al. | 442/197 |
| 7,966,668 | B2 * | 6/2011 | Bay | 2/93 |
| 2003/0065298 | A1 * | 4/2003 | Krishnaswamy-Mirle et al. | 604/378 |
| 2003/0154536 | A1 | 8/2003 | Anderson et al. | |
| 2003/0161995 | A1 * | 8/2003 | Kauschke et al. | 428/138 |
| 2003/0163106 | A1 * | 8/2003 | Blaney et al. | 604/384 |
| 2005/0044607 | A1 * | 3/2005 | Sleesen | 2/93 |
| 2005/0120452 | A1 * | 6/2005 | Cominsky | 2/9 |
| 2005/0120459 | A1 * | 6/2005 | McConnell et al. | 2/69.5 |
| 2005/0160514 | A1 * | 7/2005 | Flaniken | 2/84 |
| 2006/0047332 | A1 * | 3/2006 | Malmberg et al. | 607/104 |
| 2006/0105672 | A1 * | 5/2006 | Donnelly | 450/3 |
| 2006/0137072 | A1 * | 6/2006 | Visco et al. | 2/127 |
| 2006/0143796 | A1 * | 7/2006 | Bugarin | 2/202 |
| 2006/0223400 | A1 * | 10/2006 | Yasui et al. | 442/181 |
| 2006/0253958 | A1 * | 11/2006 | Debrick | 2/206 |
| 2007/0190880 | A1 * | 8/2007 | Dubrow et al. | 442/181 |
| 2008/0125842 | A1 * | 5/2008 | Petitt | 607/108 |
| 2008/0289078 | A1 * | 11/2008 | Mather | 2/85 |
| 2009/0007311 | A1 * | 1/2009 | Semba et al. | 2/69 |
| 2009/0216482 | A1 * | 8/2009 | Baker et al. | 702/136 |
| 2009/0260124 | A1 * | 10/2009 | Yasui et al. | 2/69 |
| 2009/0260126 | A1 * | 10/2009 | Rock et al. | 2/87 |
| 2009/0307823 | A1 * | 12/2009 | Matsushita et al. | 2/116 |
| 2010/0000541 | A1 * | 1/2010 | Baker | 128/206.13 |
| 2010/0242149 | A1 * | 9/2010 | Mickle et al. | 2/82 |
| 2011/0088137 | A1 * | 4/2011 | Ayers et al. | 2/102 |
| 2011/0099680 | A1 * | 5/2011 | Gordon et al. | 2/79 |
| 2011/0209275 | A1 * | 9/2011 | Berns et al. | 2/455 |
| 2011/0214216 | A1 * | 9/2011 | Zarabi | 2/69 |
| 2011/0225698 | A1 * | 9/2011 | Haga | 2/69 |
| 2012/0023631 | A1 * | 2/2012 | Fischer | 2/2.15 |
| 2012/0040154 | A1 * | 2/2012 | Dinescu et al. | 428/200 |
| 2012/0122365 | A1 * | 5/2012 | Erickson | 442/312 |
| 2012/0159680 | A1 * | 6/2012 | Howland | 2/2.5 |
| 2012/0171415 | A1 * | 7/2012 | Baychar | 428/138 |
| 2012/0192333 | A1 * | 8/2012 | Thompson et al. | 2/69 |
| 2012/0252296 | A1 * | 10/2012 | Sato et al. | 442/309 |
| 2012/0260422 | A1 * | 10/2012 | Rock et al. | 5/483 |
| 2012/0263910 | A1 * | 10/2012 | Baychar | 428/90 |
| 2012/0276332 | A1 * | 11/2012 | Conolly et al. | 428/138 |

* cited by examiner

NECK GAITER

FIELD

This application relates to the field of garments and, particularly, to garments having a convertible turtleneck portion.

BACKGROUND

Performing outdoor activities in cold weather can be uncomfortable. For athletes who participate in outdoor activities in cold weather, it can be a challenge to dress appropriately. To be comfortable, the athlete must maintain a comfortable overall body temperature by staying warm enough in the cold temperatures without getting too warm while body temperatures are elevated due to physical activity.

Maintaining a comfortable body temperature can be especially difficult for runners whose body temperatures often vary significantly during the course of a workout. At the beginning of a run in cold weather, a runner will feel cold and will desire warmer clothing. However, within half an hour of constant physical exertion, the heart rate and metabolism of the runner will increase significantly, thus the runner's body temperature will also increase significantly. Once the runner warms up, he will require less clothing to maintain a comfortable body temperature. If the runner stops running for a substantial period of time during the course of the run to stretch or wait for traffic, the runner's body temperature may cool down again, leading to a repeat of the process described above.

One way that a runner can deal with the range of temperatures encountered on a run is to choose whether to experience more discomfort by being colder for longer or warmer for longer. If the runner wears more clothes, he will not be as cold at the outset of the run and may not get as cold if he stops during the run, but he may be uncomfortably warm during the height of his physical exertion. Alternatively, if the runner chooses to wear fewer clothes, he will be colder at the outset of the run and if he stops during the run, but he may be more comfortable during the height of his physical exertion. Neither of these options is optimal because the runner still has to choose whether he would prefer to be uncomfortably cold or warm during a portion of his run.

An alternative way that the runner may balance the fluctuation in body temperatures during the duration of the workout is to dress in layers. As the runner's body temperature increases and decreases and the runner feels warmer and cooler, he may remove and add layers accordingly. However, this option requires a runner to carry articles of clothing that are not being worn. Additionally, this option requires a runner to change clothing during the workout. It may not be convenient or possible for a runner to carry multiple articles of clothing or have an opportunity to change clothes during the workout.

Another challenge associated with maintaining a comfortable body temperature while exercising in cold weather is managing sweat. If an athlete's body temperature is elevated too much by physical activity and multiple layers of clothing, the athlete's clothing becomes damp with sweat. The dampness makes the athlete feel colder as cold air passes over the wet fabric and transfers body heat away from the skin. One way to address damp clothing is by making the clothing out of materials which will dry quickly to prevent the loss of body heat. However, parts of the athlete's body may not be covered by articles of clothing made out of the drying material.

Another challenge associated with exercising outdoors in cold weather is maintaining comfort while breathing in cold, dry air. Humidity is a measurement of the amount of water vapor dissolved in air, and it varies as a function of both pressure and temperature. At a given pressure, the saturation temperature of water is the temperature at which water reaches an equilibrium between a liquid and a gas. When the temperature of the air is higher, the temperature of the water in the air is closer to the saturation temperature, more of the water is held in the air in vapor form and the air is more humid. When the temperature of the air is lower, the temperature of the water in the air is farther from the saturation temperature, more of the water is in liquid form and cannot be held in the air, so the air is less humid. Breathing in the cold, dry air can be uncomfortable and may result in dry coughing or even nosebleeds as the athlete's airways dry out.

One way to address breathing in cold air is by covering the nose or mouth of the athlete with fabric. As the athlete exhales, he expels heat and moisture from his lungs. The fabric captures a portion of heat and moisture expelled and retains it in the vicinity of the airways of the athlete so that when the athlete inhales, the cold and dry outside air mixes with the heat and moisture before it enters the athlete's airways. While articles of clothing exist which cover the nose or mouth, these may retain too much heat and moisture, becoming uncomfortably hot and humid. Alternatively, these articles may leave some portion of the neck exposed to the cold air, reducing the comfort of the athlete.

There is a need, therefore, for an improved garment that addresses issues associated with participating in athletic activities outdoors in cold weather. In view of the foregoing, it would be advantageous to provide an improved garment which allows an athlete to maintain a comfortable body temperature. It would be further advantageous if this garment manages sweat. It would also be advantageous if this garment allows the athlete to maintain comfort while breathing in cold air.

SUMMARY

In accordance with one embodiment of the disclosure, there is provided a garment including a torso portion and a turtleneck portion. The turtleneck portion extends from the torso portion. The turtleneck portion includes a first panel made of a first material and a second panel made of a second material. The second material is more permeable than the first material.

In accordance with another embodiment of the disclosure, there is provided a garment for being donned by a human. The garment includes a torso portion and a turtleneck portion. The turtleneck portion is coupled to the torso portion. The turtleneck portion includes a head opening configured to pass a head of the human. The turtleneck portion is configured to be selectively arranged on the human in a downward position and in an extended position. In the downward position, the turtleneck covers a neck of the human without covering a mouth of the human. In the extended position, the turtleneck portion covers the mouth of the human without covering eyes of the human. The turtleneck portion includes a span that is arranged and configured to substantially cover the mouth of the human when the turtleneck is in the extended position. The turtleneck portion is mostly made of a first material, however, the first material is not included on the span of the turtleneck portion.

In accordance with yet another embodiment of the disclosure, there is provided a convertible turtleneck garment including a torso portion and a neck portion. The torso portion includes a neck opening. The turtleneck portion is attached to the neck opening. The turtleneck portion is shaped substantially radially symmetrically about a central axis. The turtleneck portion includes a first panel made of a first material coupled to a second panel made of a second material. The second material is more permeable than the first material and is positioned in a front of the turtleneck portion.

The above described features and advantages, as well as others, will become more readily apparent to those of ordinary skill in the art by reference to the following detailed description and accompanying drawings. While it would be desirable to provide a garment having a convertible turtleneck that provides one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

Features of the garment having a convertible turtleneck are apparent to those of ordinary skill in the art from the following description with reference to the following drawings.

DESCRIPTION

Figure 1A:
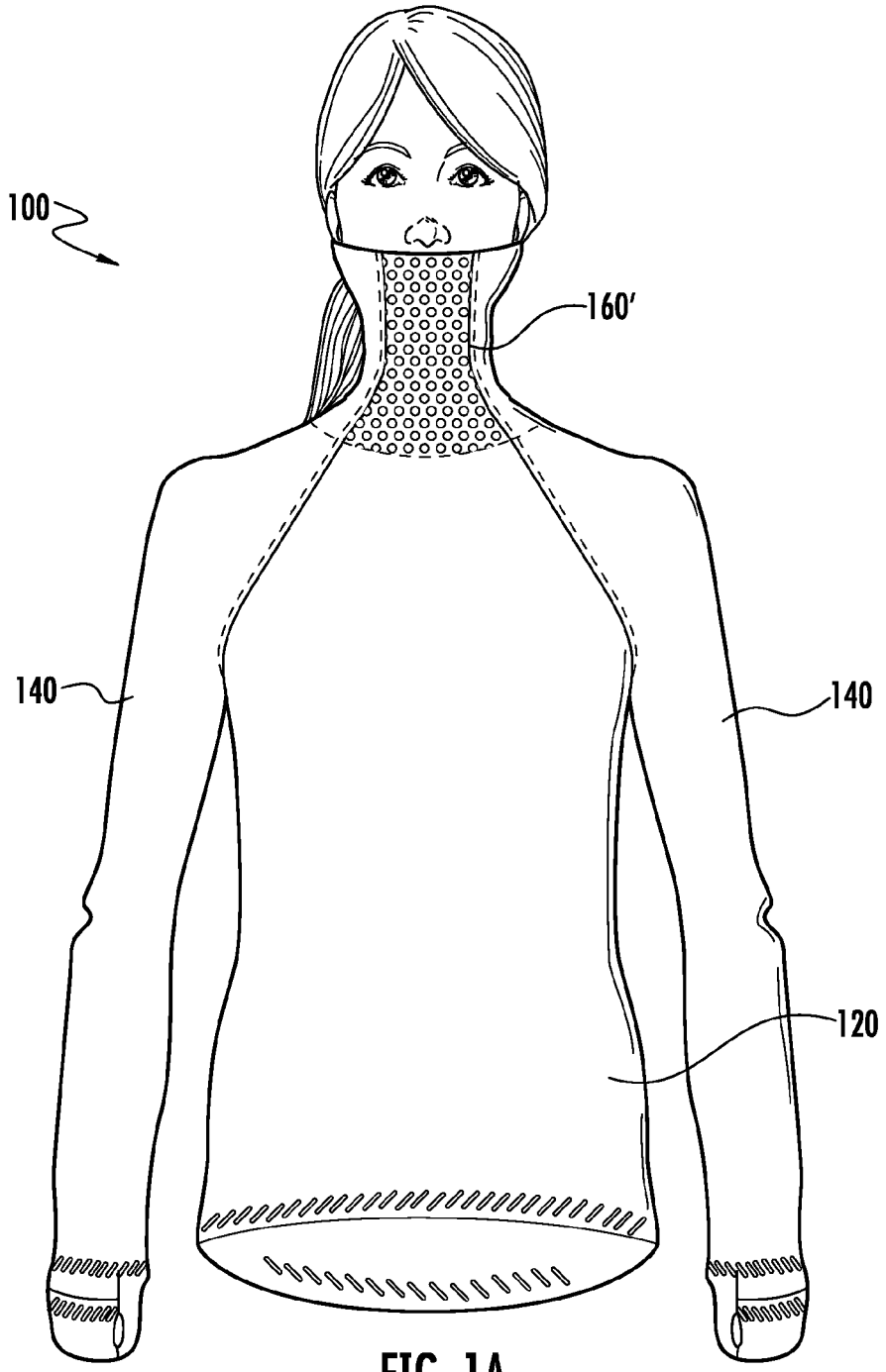
FIG. 1*a* depicts a front elevational view of a garment having a convertible turtleneck wherein a turtleneck portion of the garment is in an extended position.
Figure 1B:
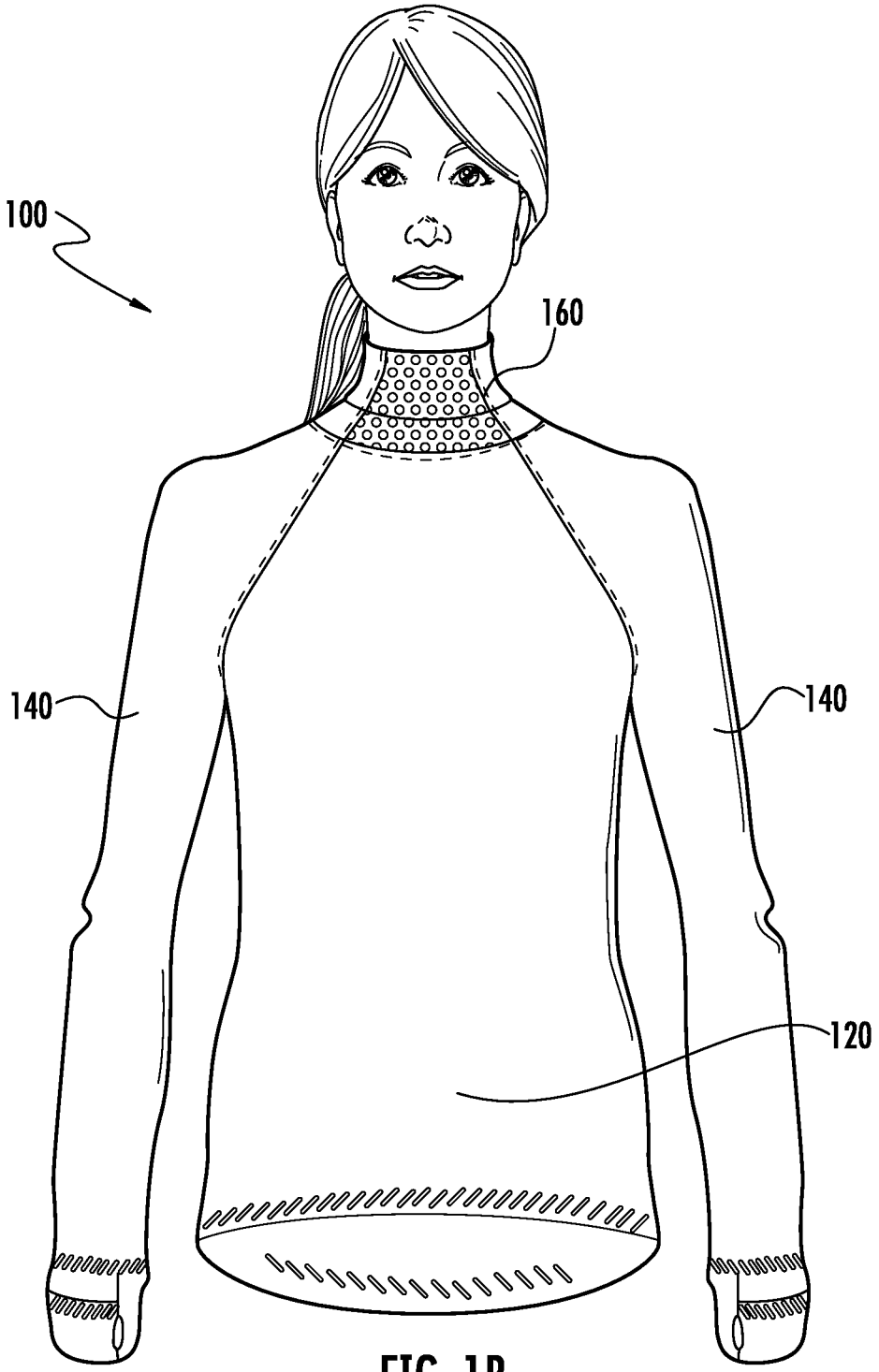
FIG. 1*b* depicts a front elevational view of the garment of FIG. 1*a* wherein the turtleneck portion is in a downward position.

FIGS. 1*a* and 1*b* depict front elevational views of a garment 100 having a convertible turtleneck. The garment 100 includes a torso portion 120, two arm portions 140, and a turtleneck portion 160 sewn together. The two arm portions 140 and the turtleneck portion 160 extend from the torso portion 120. The turtleneck portion 160 is capable of being folded down into a downward position (shown in FIG. 1*b*) wherein the turtleneck portion 160 does not cover any portion of the face of a wearer. The turtleneck portion 160 is also capable of converting by unfolding into an extended position (shown in FIG. 1*a*) wherein the turtleneck portion 160 does cover a portion of the face of a wearer.

Figure 2:
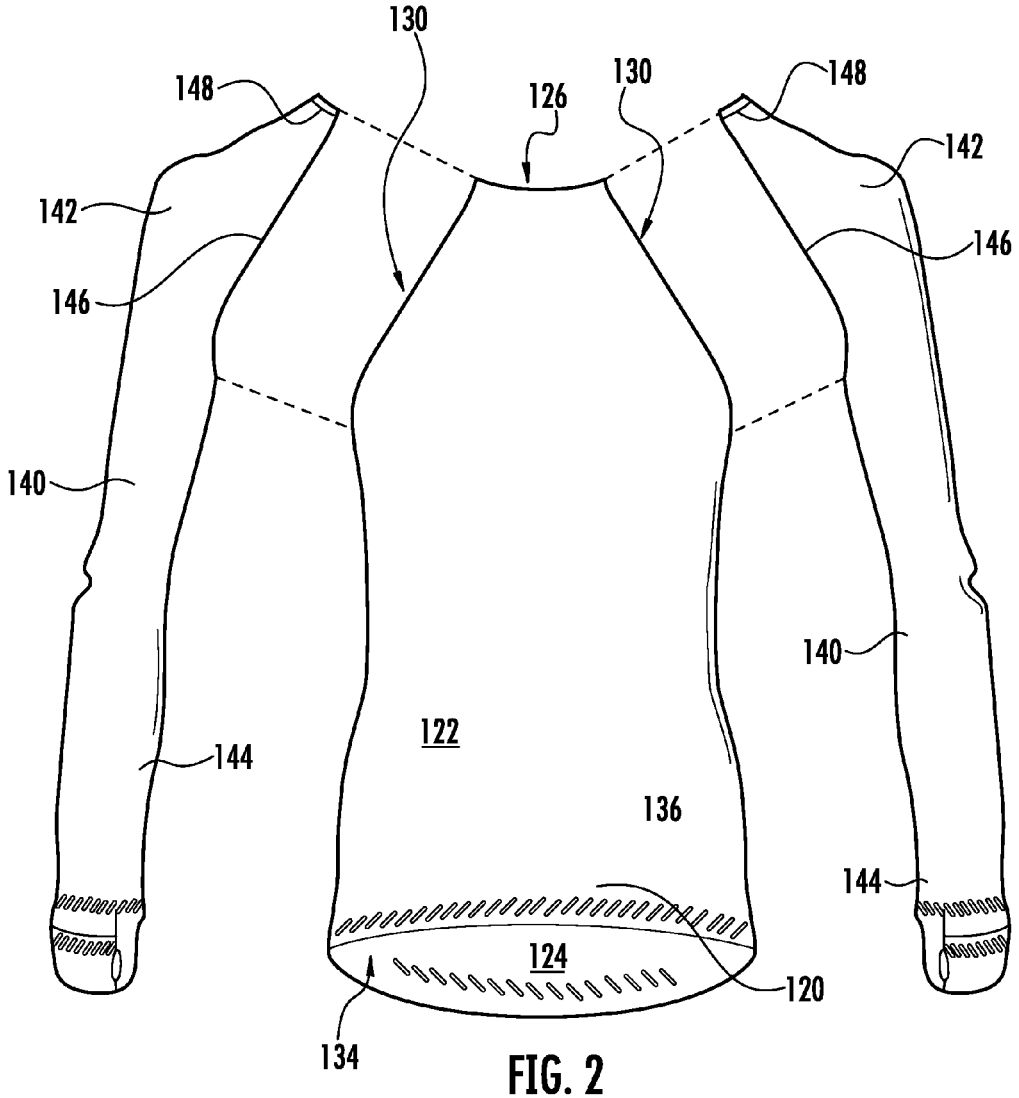
FIG. 2 depicts an exploded view of a torso portion and arm portions of the garment of FIGS. 1*a* and 1*b*.

FIG. 2 depicts an exploded view of the torso portion 120 and the two arm portions 140 of the garment 100. The torso portion 120 includes a front side 122, a back side 124, a neck opening 126, two arm openings 130 and a bottom opening 134. When the garment 100 is donned by a wearer, the front side 122 of the torso portion 120 aligns with the chest or the ventral side of the wearer and the back side 124 of the torso portion 120 aligns with the back or the dorsal side of the wearer. Additionally, the neck opening 126 is located at the top of the garment 100, the bottom opening 134 is located opposite the neck opening 126 at the bottom of the garment 100, and the arm openings 130 are located on the right and left sides of the garment 100. The neck opening 126 is positioned on the torso portion 120 such that it is adjacent to and adjoining the two arm openings 130.

In at least one embodiment, a majority of the torso portion 120 is made out of a fabric that is an elastic material, such as, for example, a material with elastane fibers. For simplicity, this material is referred to herein as an elastane material 136. The torso portion 120 is made out of the elastane material 136, such that the torso portion 120 stretches and conforms to the torso of the wearer. The elastane material 136 is stretchable such that it fits tightly to the body of the wearer and is flexible such that it moves with the body of the wearer. Additionally, the elastane material 136 is able to wick away moisture from the body of the wearer and dry quickly. Due to these features, the elastane material 136 helps keep a wearer warm and dry while wearing the garment 100 and exercising outdoors in cold weather.

Continuing with FIG. 2, each arm portion 140 includes a shoulder portion 142 and a wrist portion 144. Each arm portion 140 also includes a torso interface 146 and a turtleneck interface 148. When a wearer dons the garment 100, the shoulder portions 142 generally lie on the shoulders of the wearer and the wrist portions 144 generally lie on the wrists of the wearer. The two arm portions 140 are made out of the same elastane material 136 as the torso portion 120 such that the two arm portions 140 stretch and conform to the arms of the wearer. In alternative embodiments, the two arm portions 140 may be made out of a different material than the torso portion 120. In other embodiments, the two arm portions 140 may be completely removed from the garment 100. In other embodiments, the two arm portions 140 may have one of a variety of lengths. For example, the two arm portions 140 may be provided in the form of short sleeves, long sleeves or three-quarter length sleeves.

Figure 3:
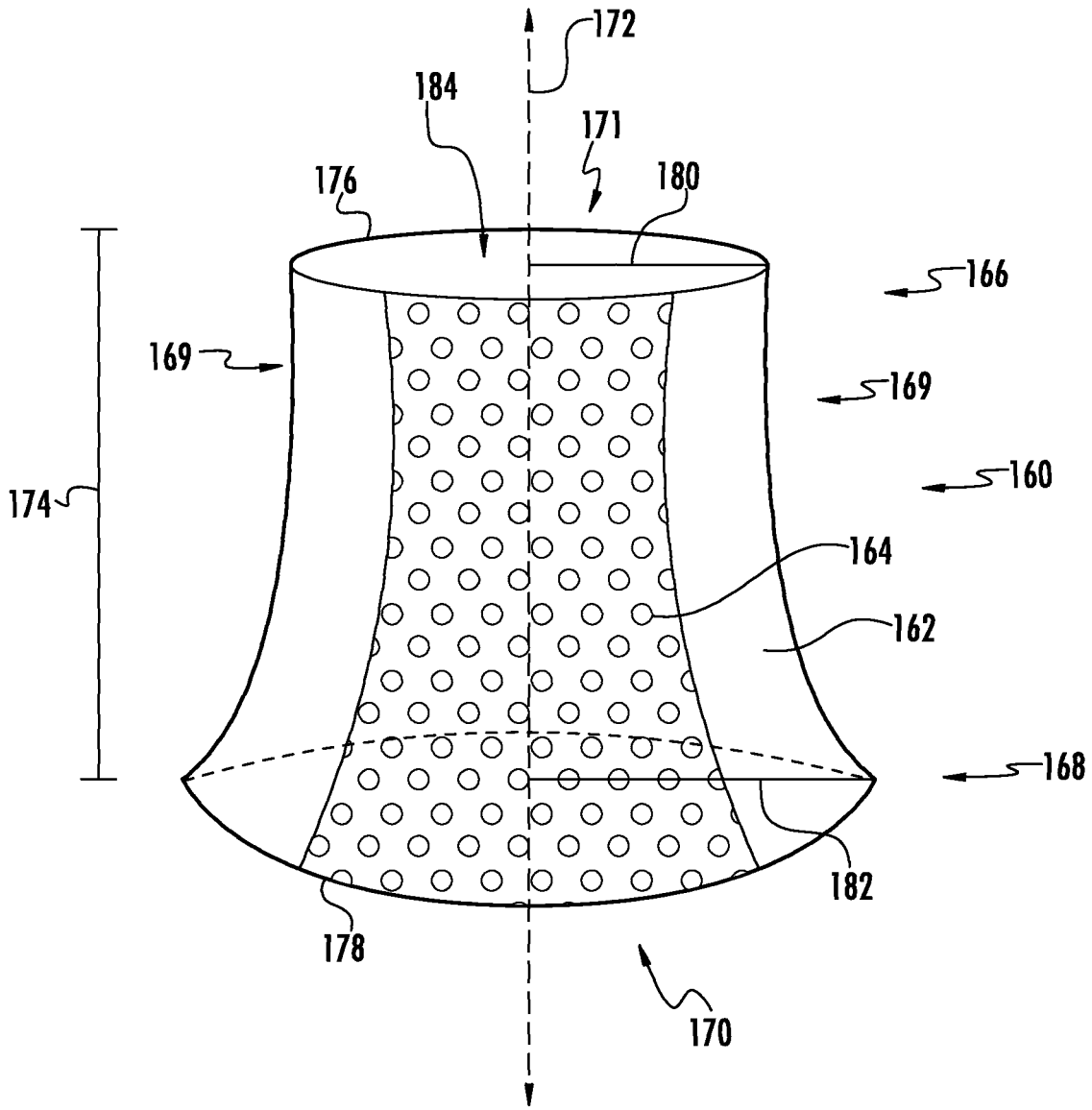
FIG. 3 depicts a front perspective view of the turtleneck portion of the garment of FIGS. 1*a* and 1*b*.

FIG. 3 depicts a front elevational view of the turtleneck portion 160 of the garment 100. The turtleneck portion 160 includes a top portion 166, a bottom portion 168, lateral portions 169, a front portion 170 and a back portion 171. The turtleneck portion 160 is comprised of a fabric that is an elastic material such as, for example, the elastane material 136. The elastane material 136 is made up of elastane fibers which are more elongated when the turtleneck portion 160 is in the extended position (shown in FIG. 1*a*) and less elongated when the turtleneck portion 160 is in the downward position (shown in FIG. 1*b*). When the turtleneck portion 160 is configured as shown in the embodiment of FIG. 3, the turtleneck portion 160 is shaped such that it is substantially radially symmetrical about a central axis 172. Thus, if horizontal or transverse cross-sections are taken of the turtleneck portion 160, each will be substantially circular with the central axis 172 being located substantially in the center of each circle. In other embodiments, the turtleneck portion 160 is shaped such that it is only symmetrical about a vertical plane extending through the turtleneck portion (e.g., the horizontal cross-section is an ellipse). In still other embodiments, the turtleneck portion 160 may be non-symmetrical.

The top portion 166 of the turtleneck portion 160 defines an upper edge 176. The upper edge 176 forms a head opening 184 which is configured to pass the head of the wearer. The top portion 166 defines a top radius 180 extending from the central axis 172 to the upper edge 176. The top radius 180 is sized such that it may pass the head of the wearer when stretched and will fit snugly over the bottom portion of the wearer's face, including the wearer's mouth, when desired (as shown in FIG. 1*a*).

With continued reference to FIG. 3, the bottom portion 168 of the turtleneck portion 160 defines a lower edge 178. The bottom portion 168 defines a bottom radius 182 extending from the central axis 172 to the lower edge 178. The bottom radius 182 is generally greater than the top radius 180. The bottom radius 182 is sized such that the lower edge 178 mates with the neck opening 126 of the torso portion 120 (shown in FIG. 2).

The relative sizes of the top radius 180 and the bottom radius 182 allow the turtleneck portion 160 to fit comfortably over the wearer's head and neck. When the top radius 180 is less than the bottom radius 182, the turtleneck portion tapers slightly when moving from the bottom portion 168 toward the top portion 166 of the turtleneck portion 160. The top radius 180 is sized such that the top portion 166 of the turtleneck portion 160 will fit tightly and remain in place over the bottom portion of the wearer's face, including the wearer's mouth, when desired. Additionally, the top radius 180 is sized such that the top portion 166 of the turtleneck portion 160 will not be uncomfortably tight on the wearer's neck or the bottom portion of the wearer's face. The bottom radius 182 is sized such that the bottom portion 168 of the turtleneck portion 160 will not be constrictive around the bottom of the wearer's neck and the top of the wearer's chest.

The lateral portions 169 of the turtleneck portion 160 are arranged and configured on the lateral sides of the garment 100. The front portion 170 of the turtleneck portion 160 is arranged and configured on the front side 122 of the garment 100 (shown in FIG. 2). The back portion 171 of the turtleneck portion 160 is arranged and configured on the back side 124 of the garment 100 (shown in FIG. 2). The front portion 170 is coupled to the lateral portions 169 and the lateral portions are coupled to both the front portion 170 and the back portion 171 such that the front portion 170, lateral portions 169 and back portion 171 form a complete cylinder. The front portion 170 is arranged and configured to cover the front of the wearer's neck, including the wearer's laryngeal prominence (also known as the Adam's apple). When the turtleneck portion 160 is in the extended position, as shown in FIG. 1*a*, the front portion 170 also covers a portion of the face of the wearer, including the wearer's mouth.

In an alternative embodiment, the turtleneck portion 160 may also include a head portion coupled to the back portion 171 of the turtleneck portion 160 which extends over the top of the wearer's head. In this embodiment, when the turtleneck portion 160 is in the extended position, the turtleneck portion 160 does not cover a wearer's eyes, but does cover a portion of the face of the wearer, including the wearer's mouth and also covers the top of the wearer's head.

With continued reference to FIG. 3, a height 174 of the turtleneck portion 160 extends along the central axis 172 of the turtleneck portion 160. The height 174 of the turtleneck portion 160 is sufficient to cover the wearer's neck and at least a portion of the bottom of the wearer's face, including the wearer's mouth, when the turtleneck portion 160 is in the extended position, as shown in FIG. 1*a*. At the same time, the height 174 of the turtleneck portion 160 is not long enough to cover the top of the wearer's head or the wearer's eyes when the turtleneck portion 160 is in the extended position, as shown in FIG. 1*a*. The turtleneck portion 160 may be easily folded down to the downward position, as shown in FIG. 1*b*, such that it does not cover any portion of the wearer's face. Also, when it is in the downward position, as shown in FIG. 1*b*, the turtleneck portion 160 may cover only a portion of the wearer's neck or may cover all of the wearer's neck.

Figure 4:
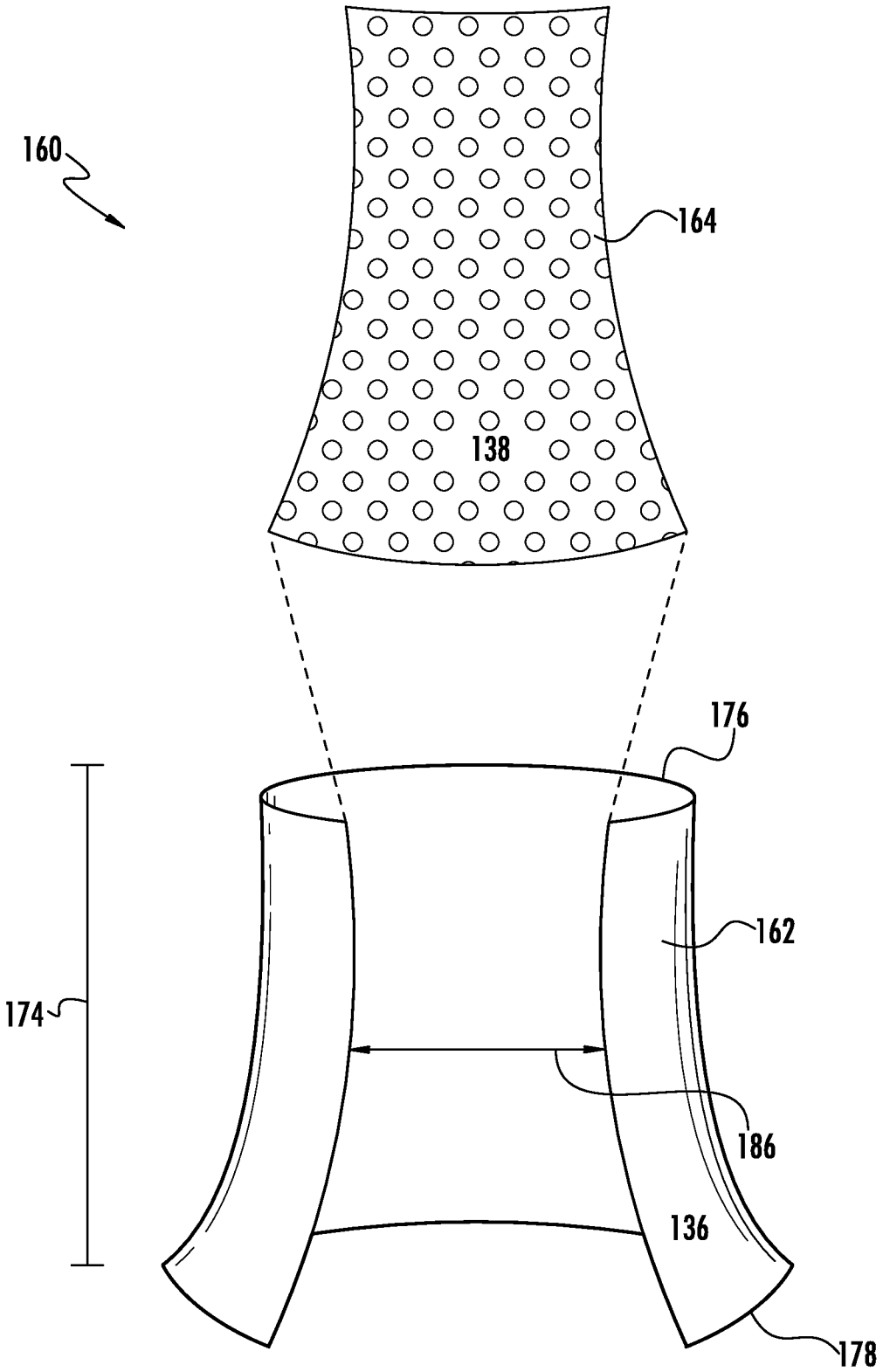
FIG. 4 depicts an exploded view of the turtleneck portion of the garment of FIGS. 1*a* and 1*b*.

FIG. 4 depicts an exploded view of the turtleneck portion 160 which better illustrates the construction of the turtleneck portion 160. The turtleneck portion 160 includes a first panel 162 and a second panel 164. The first panel 162 generally extends along the lateral portions 169 and back portion 171 of the turtleneck portion 160. The first panel 162 is made out of the same fabric as the torso portion 120 and the two arm portions 140 (shown in FIG. 2), such as the elastane material 136. In alternative embodiments, the first panel 162 may not be made out of the same fabric as the torso portion 120 and the two arm portions 140, but may be made out of a different fabric. The fabric of the first panel 162 defines a first permeability. The permeability of a material refers to the rate of fluid flow passing through a known area of the material under a prescribed fluid pressure differential between the two surfaces of the material. Under the same conditions, a material having a higher permeability passes fluid more rapidly than a material having a lower permeability. The first permeability of the first panel 162 may be, for example, less than 250 cubic feet of air per minute (cfm) when the test area is 38 cm squared and the test pressure is 125 Pascals. In various embodiments, the first permeability of the first panel 162 may be, for example, about 100 cfm or less, about 150 cfm or about 200 cfm or more.

With continued reference to FIG. 4, the second panel 164 is provided along a span 186 of the turtleneck portion 160 that extends horizontally across the front portion 170 (shown in FIG. 3). In the embodiment of FIG. 4, the span 186 also extends the entire height 174 of the turtleneck portion 160. No material from the first panel 162 is included in the span 186. The second panel 164 is configured such that, when the turtleneck portion 160 is arranged as shown in FIG. 3, the permeable elastane material 138 is arranged and configured to extend across the span 186 on the turtleneck portion 160. Thus, the second panel 164 extends along the entire height 174, from the upper edge 176 to the lower edge 178, of the turtleneck portion 160. This arrangement, as shown in FIG. 3, results in the second panel 164 being positioned in the front portion 170 of the turtleneck portion 160 and results in the permeable elastane material 138 being positioned over a portion of the face of a wearer, including the wearer's mouth, when the turtleneck portion 160 is in the extended position (shown in FIG. 1*a*).

The second panel 164 is made out of a fabric that is an elastic material such as, for example, a material with elastane fibers. For simplicity, this material is referred to herein as a permeable elastane material 138 which defines a second permeability. The permeable elastane material 138 has properties similar to those of the elastane material 136, but the second permeability of the permeable elastane material 138 is greater than the first permeability of the fabric of the first panel 162. As noted above, permeability refers to the ability of fluids, including liquids and gases, to pass through the material. Thus, the permeable elastane material 138 allows more air and water vapor to pass through than the fabric of the first panel 162. The second permeability of the second panel 164 may be, for example, greater than 250 cfm when the test area is 38 cm squared and the test pressure is 125 Pascals. In at least one embodiment, the second permeability of the second panel 164 may be, for example, 330 cfm. Accordingly, in at least one embodiment, the second permeability of the second panel 164 may be two times or three times greater than the permeability of the first panel 162.

Returning to FIG. 3, the first panel 162 and the second panel 164 are sewn together along the height 174 to make up the turtleneck portion 160. The first panel 162 extends over more than 50% of the turtleneck portion 160 and the second panel 164 extends over at least 10% of the turtleneck portion 160 aligned with the front side 122 of the garment 100. The first panel 162 is configured such that the majority of the wearer's neck and face will be covered by the elastane material 136 when the turtleneck portion 160 is in the extended position (shown in FIG. 1*a*). The second panel 164 is configured such that at least the mouth of the wearer and the portion of the face surrounding the mouth of the wearer will be covered by the permeable elastane material 138 when the turtleneck portion 160 is in the extended position (shown in FIG. 1*a*).

In alternative embodiments, the span 186 may be narrower such that the second panel 164 covers a smaller portion of the front portion 170 of the turtleneck portion 160, so long as the second panel 164 and the permeable elastane material 138 covers the mouth of the wearer when the turtleneck portion 160 is in the extended position as shown in FIG. 1*a*. Additionally, the span 186 may not extend along the entire height 174 of the turtleneck portion 160 such that the second panel 164 covers a smaller portion of the front portion 170 of the turtleneck portion 160, so long as the second panel 164 and the permeable elastane material 138 covers the mouth of the wearer when the turtleneck portion 160 is in the extended position as shown in FIG. 1*a*.

To form the garment 100 as shown in FIGS. 1*a* and 1*b*, the torso portion 120, the two arm portions 140 and the turtleneck portion 160 are sewn together. The torso interfaces 146 (shown in FIG. 2) of the two arm portions 140 are sewn to the arm openings 130 of the torso portion 120. The lower edge 178 of the turtleneck portion 160 is sewn to the neck opening 126 of the torso portion 120 so that the front portion 170 of the turtleneck portion 160 is aligned with the front side 122 of the torso portion 120. The lower edge 178 of the turtleneck portion 160 is also sewn to the turtleneck interfaces 148 (shown in FIG. 2) of the two arm portions 140.

In an alternative embodiment, the garment 100 may be formed by sewing together the torso portion 120, the two arm portions 140 and the turtleneck portion 160 in a different manner. For example, the neck opening 126 may not be located on the torso portion 120 such that the neck opening 126 is adjacent to and adjoining the two arm openings 130. In this alternative embodiment, the two arm portions 140 need not include turtleneck interfaces 148 as the two arm portions 140 and the turtleneck portion 160 will not be sewn to one another. In this embodiment, the garment 100 is formed by sewing the torso interfaces 146 of the two arm portions 140 to the arm openings 130 of the torso portion 120. The lower edge 178 of the turtleneck portion 160 is sewn to the neck opening 126 of the torso portion 120 so that the front portion 170 of the turtleneck portion 160 is aligned with the front side 122 of the torso portion 120.

In operation, a wearer dons the garment 100 by inserting his head and arms through the bottom opening 134 of the torso portion 120. The wearer then inserts his head through the turtleneck portion 160 and the head opening 184 at the upper edge 176 of the turtleneck portion 160 and inserts his arms through the two arm portions 140 such that his shoulders are generally aligned with the shoulder portions 142 and his wrists are generally aligned with the wrist portions 144 of the two arm portions 140. The garment 100 stretches such that it fits tightly to the arms and torso of the wearer and flexes when the wearer moves.

To regulate the temperature of the lower portion of his face, the wearer may adjust the turtleneck portion 160 of the garment 100. To warm the lower portion of his face and increase the heat and humidity of the air he is breathing into his air passages, the wearer may pull the turtleneck portion 160 up over the bottom portion of his face such that the turtleneck portion 160 is in the extended position, as shown in FIG. 1*a*. When the turtleneck portion 160 is in the extended position, the majority of the lower portion of his face may be covered by the elastane material 136. The elastane material 136 retains body heat expelled by the wearer, keeping the lower portion of his face warmer. The mouth area of the lower portion of the wearer's face is covered by the permeable elastane material 138. The permeable elastane material 138 allows the wearer to breathe comfortably by allowing an adequate amount of air to pass through the second panel 164 of the turtleneck portion 160. The permeable elastane material 138 also retains some of the moisture of the breath expelled by the wearer. Retaining this moisture allows the wearer to breathe more comfortably by increasing the humidity of the air breathed into his air passages.

If the wearer begins to get too warm or the air he is breathing in begins to get too humid, he may remove the lower portion of his face from the turtleneck portion 160. To remove the lower portion of his face from the turtleneck portion 160, the wearer may pull the turtleneck portion 160 down past the bottom portion of his face such that it covers only his neck and the turtleneck portion 160 is in the downward position, as shown in FIG. 1*b*. As desired, the wearer may regulate his body temperature and the humidity of the air that he breathes into his air passages by alternately pulling up the turtleneck portion 160 into the extended position and pulling down the turtleneck portion 160 into the downward position.

Figure 5:
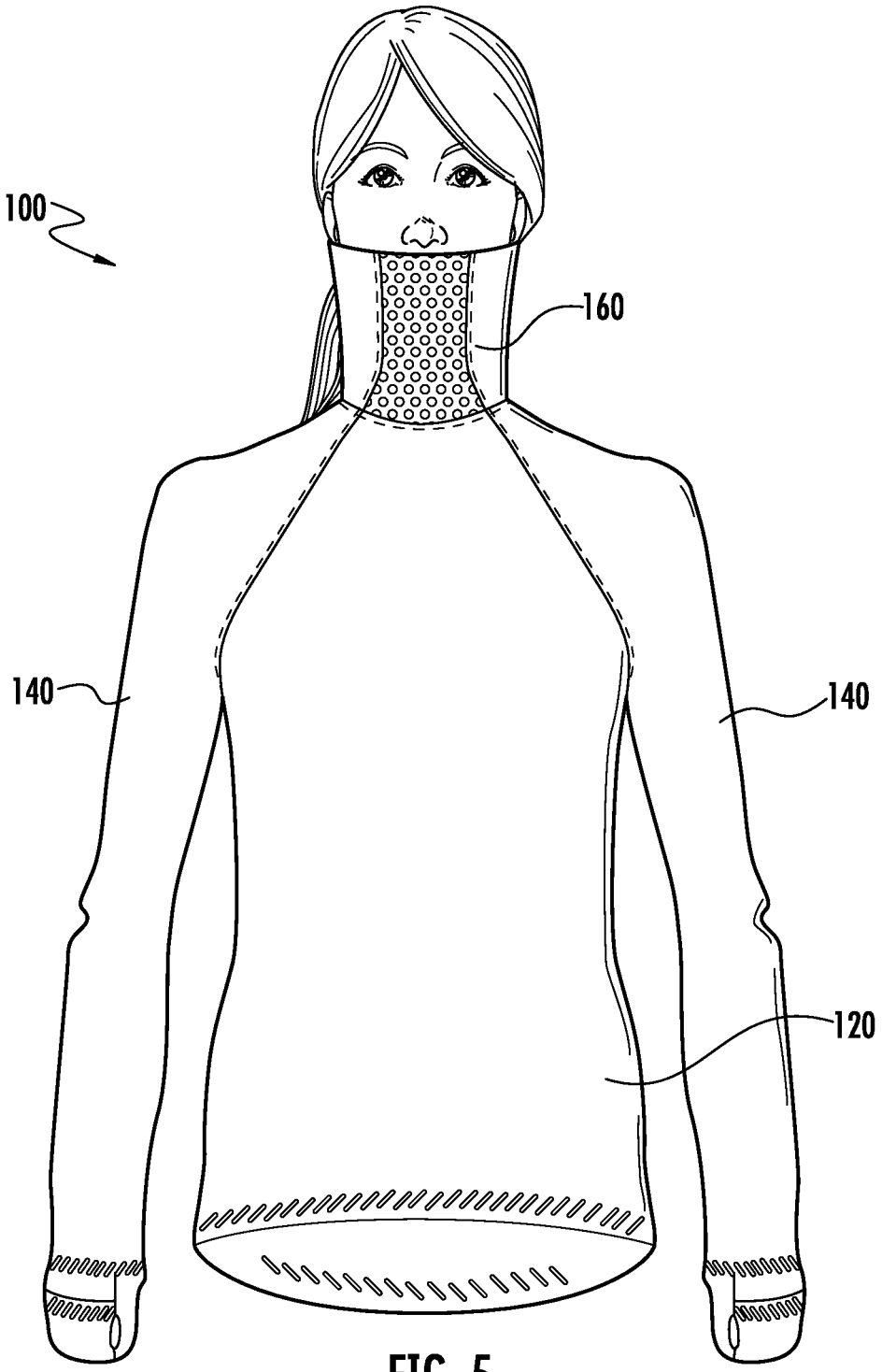
FIG. 5 depicts a front elevational view of an alternative embodiment of the garment having a convertible turtleneck wherein the turtleneck portion of the garment is in an extended position.

In an alternative embodiment, depicted in FIG. 5, the garment 100 has a turtleneck portion 160' which remains substantially cylindrical in shape, rather than conforming to the shape of the wearer's neck and the bottom of the wearer's face, when in the extended position. To retain its substantially cylindrical shape when in the extended position, the turtleneck portion 160' may be constructed out of a fabric or elastic material which is more rigid and less conforming than the elastane material 136 and the permeable elastane material 138. In addition or in the alternative, the turtleneck portion 160' may be constructed out of a fabric or elastic material which is more stretchable at the top portion and less stretchable at the bottom portion such that the top portion constricts slightly to be held in place on the bottom of the face of the wearer, but the bottom portion does not conform to the neck of the wearer. The garment 100 having the turtleneck portion 160' may be less constricting and more comfortable for some wearers.

The foregoing detailed description of one or more embodiments of the garment having a convertible turtleneck has been presented herein by way of example only and not limitation. It will be recognized that there are advantages to certain individual features and functions described herein that may be obtained without incorporating other features and functions described herein. Moreover, it will be recognized that various alternatives, modifications, variations or improvements of the above-disclosed embodiments and other features and functions, or alternatives thereof, may be desirably combined into many other different embodiments, systems or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. A garment comprising:

a torso portion; and a turtleneck portion extending from the torso portion, the turtleneck portion including a first panel comprised of a first material and a second panel comprised of a second material, the second material being more permeable than the first material, wherein the second panel is arranged and configured on the turtleneck portion to cover a wearer's mouth when the turtleneck portion is in an extended position.

2. The garment of claim 1 wherein the torso portion is comprised of the first material.

3. The garment of claim 1 wherein the first panel extends over more than fifty percent of the turtleneck portion, and wherein the second panel extends over at least ten percent of the turtleneck portion.

4. The garment of claim 1 wherein the turtleneck portion includes an upper edge and a lower edge, the distance between the upper edge and the lower edge defining a height, wherein the lower edge of the turtleneck portion is attached to a neck opening of the torso portion and the height of the turtleneck portion is sufficient to cover a wearer's neck and at least a portion of the bottom of the wearer's face, and wherein the second material extends from the upper edge to the lower edge of the turtleneck portion.

5. The garment of claim 1 wherein the first panel is arranged and configured on the turtleneck portion to cover a back of the wearer's neck when the turtleneck portion is in an extended position.

6. The garment of claim 5 wherein the first material includes elastane fibers, wherein the elastane fibers are more elongated when the turtleneck portion is in the extended position covering the wearer's mouth, and wherein the elastane fibers are less elongated when the turtleneck portion is in a downward position covering the wearer's neck, but not the wearer's mouth.

7. The garment of claim 1 wherein the second material is arranged and configured on the turtleneck portion to fill a span on the turtleneck portion that is substantially void of the first material.

8. A garment being donned by a human, the garment comprising:

a torso portion;

a turtleneck portion coupled to the torso portion, the turtleneck portion including a head opening configured to pass a head of the human, the turtleneck portion configured to be selectively arranged on the human (i) in a downward position wherein the turtleneck covers a neck of the human without covering a mouth of the human, and (ii) in an extended position wherein the turtleneck portion covers the mouth of the human without covering eyes of the human, the turtleneck portion mostly comprised of a first material, wherein the first material is not included on a span of the turtleneck portion arranged and configured to substantially cover the mouth of the human when the turtleneck portion is in the extended position, and wherein the span of the turtleneck portion arranged and configured to substantially cover the mouth of the human includes a second material that is more permeable than the first material.

9. The garment of claim 8 wherein the span of the turtleneck portion arranged and configured to substantially cover the back and sides of the neck of the human includes the first material.

10. The garment of claim 8 wherein the first material is included on most of the torso portion.

11. The garment of claim 8 wherein the turtleneck portion includes an upper edge and a lower edge, wherein the lower edge of the turtleneck portion is attached to the torso portion, and wherein the second material extends from the upper edge to the lower edge of the turtleneck portion.

12. The garment of claim 8 wherein the torso portion includes a neck opening and two arm openings, the turtleneck portion is attached to the torso portion at the neck opening, and when the turtleneck portion is in the extended position, the turtleneck portion covers the mouth of the human without covering a top of the head.

13. The garment of claim 8 wherein the first material includes elastane fibers, wherein the elastane fibers are elongated when the turtleneck portion is in the extended position covering the human's mouth.

14. A convertible turtleneck garment comprising:

a torso portion including a neck opening; and a turtleneck portion attached to the neck opening, the turtleneck portion being shaped substantially radially symmetrically about a central axis, the turtleneck portion including a first panel made of a first material coupled to a second panel made of a second material, the second material being more permeable than the first material and positioned in a front of the turtleneck portion, the first panel covering a rear of the turtleneck portion and the second panel covering a front of the turtleneck portion.

15. The convertible turtleneck garment of claim 14 wherein the turtleneck portion includes a bottom fixed to the neck opening and a top opposite the bottom, the top having a top radius and the bottom having a bottom radius, wherein the top radius is smaller than the bottom radius.

16. The convertible turtleneck garment of claim 14 wherein the turtleneck portion defines a height extending in the direction of the central axis, the second panel extending the height of the turtleneck portion.

17. The convertible turtleneck garment of claim 14 wherein the second panel is centered on the front of the turtleneck portion and is fixed to the neck opening.

18. The convertible turtleneck garment of claim 14 wherein the first material comprises an elastic material such that the first material is configured to stretch over a bottom portion of a wearer's face and fit tightly about the bottom portion of the wearer's face.

19. The convertible turtleneck garment of claim 14 further comprising arm portions, wherein the arm portions are coupled to the torso portion, wherein the turtleneck portion is coupled to the arm portions.

20. The convertible turtleneck garment of claim 19 wherein each arm portion includes a torso interface and a turtleneck interface, each arm portion is coupled to the torso portion at the torso interface and each arm portion is coupled to the turtleneck portion at the turtleneck interface.

* * * * *